United States Patent [19]

Amir et al.

[11] Patent Number: 4,471,621

[45] Date of Patent: Sep. 18, 1984

[54] METHOD AND APPARATUS FOR DRAINING LIQUID WORKING FLUID FROM TURBINE CANNISTER OF A CLOSED CYCLE POWER PLANT

[75] Inventors: Nadav Amir, Rehovot; Haim Hershman; Avi Katz, both of Givat Shmuel; Meir Rigel, Benaya, all of Israel

[73] Assignee: Ormat Turbines, Ltd., Yavne, Israel

[21] Appl. No.: 217,082

[22] Filed: Dec. 16, 1980

[51] Int. Cl.[3] ..... F01K 11/00; F01K 25/08

[52] U.S. Cl. ..... 60/657; 60/671; 60/688; 60/689; 60/669

[58] Field of Search ..... 60/651, 671, 657, 669, 60/670, 688, 689

[56] References Cited

U.S. PATENT DOCUMENTS

| | | | |
|---|---|---|---|
| 3,292,366 | 12/1966 | Rice et al. | 60/651 |
| 3,393,515 | 7/1968 | Tabor et al. | 60/669 |
| 3,462,951 | 8/1969 | Moore | 60/657 |
| 3,842,593 | 10/1974 | Bronicki | 60/671 |
| 3,845,628 | 11/1974 | Bronicki | 60/656 |
| 4,262,485 | 4/1981 | Kuroda | 60/671 X |

FOREIGN PATENT DOCUMENTS

| | | |
|---|---|---|
| 290990 | 3/1929 | United Kingdom . |
| 371281 | 4/1932 | United Kingdom . |
| 1049277 | 11/1966 | United Kingdom . |
| 1073793 | 6/1967 | United Kingdom . |
| 1431955 | 4/1976 | United Kingdom . |

*Primary Examiner*—Allen M. Ostrager

*Attorney, Agent, or Firm*—Sandler & Greenblum

[57] ABSTRACT

Liquid working fluid is drained from the sump of the cannister of a power plant of the type described by transferring the working fluid to the condenser rather than to the boiler. In one embodiment of the invention, liquid in the sump is drained by gravity into an auxiliary boiler which heats the drained liquid producing vapor at substantially the pressure of the condenser; and the resultant vapor is piped directly into the condenser where it condenses and joins the main condensate produced from vapor that has been exhausted from the turbine. In a second embodiment of the invention, the exhaust conduit carrying exhaust vapor from the cannister to the condenser is provided with a loop or elbow that extends below the level of the cannister, and a conduit connects the sump in the cannister to the loop. As a consequence, liquid working fluid in the cannister drains by gravity into the bottom of the loop where it is vaporized or swept by extracting superheat from the exhaust vapor and then returned to the condenser. This arrangement is advantageous in that no additional fuel is utilized to vaporize the drained liquid. Furthermore, the work required of the condenser is reduced because of the reduction in superheat of the vapor entering the condenser.

18 Claims, 2 Drawing Figures

METHOD AND APPARATUS FOR DRAINING LIQUID WORKING FLUID FROM TURBINE CANNISTER OF A CLOSED CYCLE POWER PLANT

TECHNICAL FIELD

This invention relates to a closed cycle power plant and more specifically to a closed Rankine cycle power plant including apparatus for draining condensed working fluid from the cannister containing the prime mover.

BACKGROUND ART

A closed, Rankine cycle power plant is disclosed in each of U.S. Pat. Nos. 3,842,593 and 3,845,628 wherein an organic working fluid is vaporized in a boiler and supplied to a prime mover housed in a hermetically sealed cannister, such power plant being termed hereinafter, a power plant of the type described. Generally, in a power plant of the type described, the prime mover is a turbine that drives a generator producing power. The vapor exhausted from the turbine is passed into a condenser which converts the exhaust vapor into condensate at a lower temperature and pressure than in the boiler. Some of the condensate in the condenser is supplied to the bearings of the turbine/generator and the remainder is returned to the boiler, either directly, if the condenser elevation relative to the boiler is sufficient, or via a pump if the elevation is insufficient.

The cannister is essentially at the condenser pressure by reason of the exhaust conduit from the turbine, and is relatively cool. As a consequence, the cannister acts as a secondary condenser for exhaust vapors present in the cannister, such vapors condensing in the cannister and collecting as a liquid in a sump at the lowest level therein. In addition, leakage of lubricating working fluid from the bearings contributes to the liquid in the bottom of the cannister. To prevent its flooding, the cannister must be provided with a system that will drain liquid working fluid, preferably, as efficiently as possible.

One approach is to elevate the cannister relative to the boiler sufficiently to establish a liquid head that will force the liquid into the boiler. This approach requires no energy, but the price is a power plant that is vertically elongated to provide the necessary liquid head between the cannister and the boiler. Where it is necessary, or desirable, to reduce or to minimize the vertical height of the power plant, this approach is not satisfactory; and in such case, it is conventional to pump the liquid in the cannister into the boiler. The problem here is the extra component represented by the pump and the power expended thereby. In a small, highly reliable power plant, of said 1 Kw rating, any extra component or wasted power will reduce the reliability, efficiency and operating capacity of the system.

Therefore, it is an object of the present invention to provide a method of and apparatus for draining a cannister containing the prime mover of a power plant of the type described, wherein the cannister is drained without adversely affecting the reliability, operating efficiency or capacity of the system.

DISCLOSURE OF INVENTION

In accordance with the present invention, liquid working fluid is drained from the sump of the cannister of a power plant of the type described by transferring the working fluid to the condenser rather than to the boiler. In one embodiment of the invention, liquid in the sump is drained by gravity into an auxiliary boiler which heats the drained liquid producing vapor at substantially the pressure of the condenser; and the resultant vapor is piped directly into the condenser where it condenses and joins the main condensate produced from vapor that has been exhausted from the turbine. Preferably, the auxiliary boiler is constituted by a chamber adjacent and in a heat conductive relationship to the main boiler of the power plant, the auxiliary boiler being heated by the hot liquid working fluid in the main boiler.

It being understood that less than 5% of the mass flow of working fluid produced by the main boiler is involved in liquid collecting in the cannister and so only a small percentage of heat supplied to the main boiler by the fuel is used by the auxiliary boiler.

In this embodiment of the invention, the auxiliary boiler is located at substantially the same level as the main boiler which is immediately below the cannister. This reduces the combined height of these components of the power plant. In such case, the condenser may be elevated sufficiently to provide a gravity feed of condensate into the boiler; or, the condenser could be immediately above the cannister and a pump driven by the turbine can be used to return condensate to the boiler.

In a second embodiment of the invention, the exhaust conduit carrying exhaust vapor from the cannister to the condenser is provided with a loop or elbow that extends below the level of the cannister, and a conduit connects the sump in the cannister to the loop. As a consequence, liquid working fluid in the cannister drains by gravity into the bottom of the loop where it is swept or vaporized by extracting superheat from the exhaust vapor and then returned to the condenser. This arrangement is advantageous in that no additional fuel is utilized to vaporize the drained liquid. Futhermore, the work required of the condenser is reduced because of the reduction in superheat of the vapor entering the condenser.

BRIEF DESCRIPTION OF THE DRAWINGS

Embodiments of the present invention are shown in the accompanying drawings wherein.

BEST MODE FOR CARRYING OUT THE INVENTION

Figure 1:
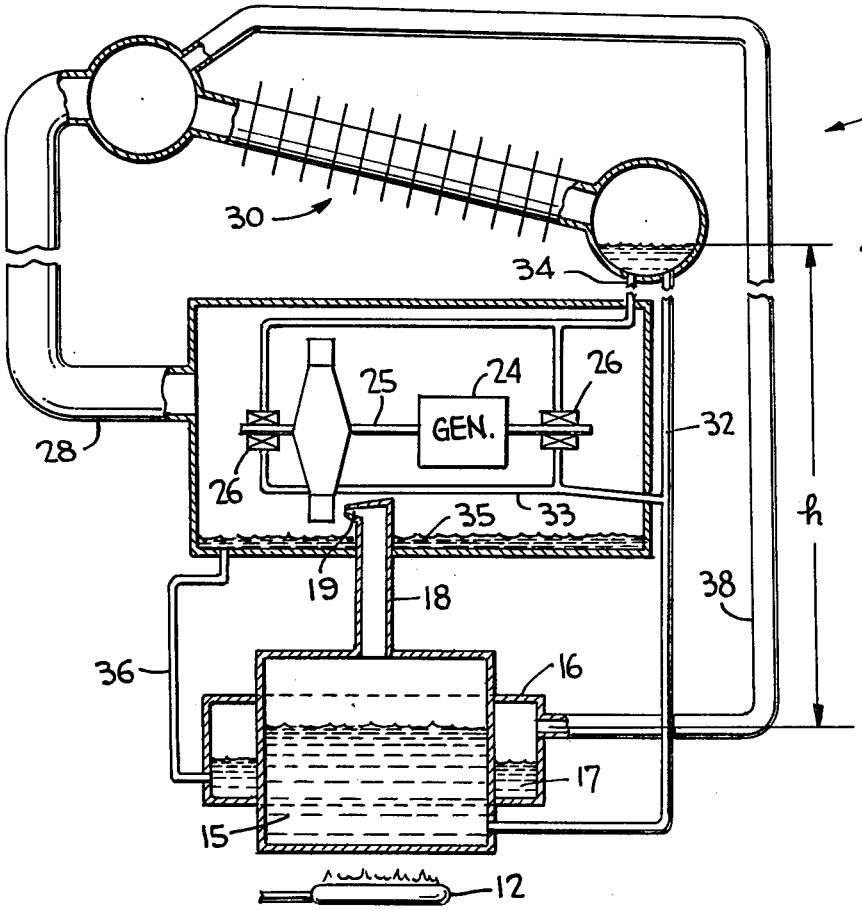
FIG. 1 is a schematic view of a first embodiment of a power plant of the type described which includes apparatus for draining condensate from a cannister utilizing an auxiliary boiler.

Referring now to FIG. 1, reference numeral 10 designates a closed, Rankine cycle power plant according to the present invention. Power plant 10 comprises 3 main components; main boiler 14; cannister 20 containing a prime mover in the form of turbine 22, driving generator 24; and condenser 30. Main boiler 14 contains liquid organic working fluid 15, such as Freon or the like, which is heated by burner 12 producing vapor that passes through supply conduit 18 into cannister 20 positioned above the boiler. Connected to the outlet of conduit 18 is nozzle system 19 which directs vaporized working fluid at boiler pressure into the blades of the turbine. After the vaporized working fluid expands through the turbine, which rotates and drives the generator in response, the exhaust vapor is conducted to the condenser by exhaust conduit 28. The temperature and pressure levels of the exhaust vapor are determined by the heat rejection capability of the condenser: and because the turbine is not sealed in the cannister, levels of vapor pressure and temperature in the cannister will be substantially the same as in the condenser. During steady state operation, the condenser pressure and hence the cannister pressure will be of the order of magnitude of about $\frac{1}{3}$ of an atmosphere while the pressure in the boiler will be from 2 to 3 atmospheres.

A small percentage of the condensate produced by condenser 30 (for example about 2%) is conveyed by conduit 34 from the condenser to hydrostatic bearings 26 which carry shaft 25 on which the turbine and generator are mounted. Except for a very small quantity of condensate that leaks from the hydrostatic bearings, the lubricating working fluid is returned by conduit 33 to conduit 32 which constitutes the main condensate return to the boiler.

In order to improve reliability and eliminate the need for a pump to return the condensate from the condenser to the boiler, condenser 30 is located above the boiler. The elevation of the condenser is such that the pressure head due to the condensate contained in conduit 32 (the head being designated by the quantity "h" in FIG. 1), when added to the pressure in the condenser, will exceed the pressure in the boiler thereby permitting the condensate to enter the boiler without the use of a pump.

Because cannister 20 is filled with exhaust vapor from the turbine, and because the cannister is subject to being cooled, the cannister acts as a secondary condenser. Vaporized working fluid within the cannister thus continuously condenses on the inner walls of the cannister and runs into and collects in a sump at the bottom of the cannister. The liquid contained in the sump is indicated by reference numeral 35 in FIG. 1.

Instead of returning liquid 35 in the sump directly into the boiler which would necessitate the use of a pump, or the elevation of cannister 20 above boiler 14 at a height sufficient to produce a liquid head that forces the fluid in the sump into the boiler, the liquid working fluid is drained from the sump and transferred to the condenser rather than to the boiler. Because the pressure in the sump is essentially the pressure of the condenser, the only work required to effect the transfer of sump liquid to the condenser is the work required to raise the liquid through the difference in elevation between the condenser and the sump. In general, such work is furnished by a heat exchanger that vaporizes the sump liquid. In the first embodiment of the invention, the sump liquid in the heat exchanger is indirectly heated. Specifically, liquid in the sump is drained by gravity into auxiliary boiler 16 where the drained liquid is heated and converted into a vapor at substantially the pressure of the condenser. The resultant vapor is piped directly into the condenser via conduit 38 where it condenses and joins the main condensate produced from vapor that has been exhausted from the turbine.

As shown in FIG. 1, the auxiliary boiler may be constituted by a chamber adjacent and in heat conductive relationship to the main boiler 14. The sump liquid in the auxiliary boiler is thus heated by conduction from the hot liquid working fluid in the main boiler. Because liquid in the auxiliary boiler need be supplied with only the latent heat vaporization at essentially the condenser pressure, only a small amount of heat is required to transfer the sump liquid into the condenser.

In this embodiment, it can be seen that the energy required to raise liquid 35 in the cannister to the level of liquid in condenser 30 above the cannister is supplied by heat extracted from the liquid working fluid in the main boiler. Alternatively, the auxiliary boiler can be associated more directly with burner 12 and the heat can be derived directly from the burning fuel. However, the arrangement shown in FIG. 1 is preferred because no significant modification of the burner or boiler need be made except for the provision of the annular shell 16 which surrounds the main boiler which constitutes the auxiliary boiler.

Figure 2:
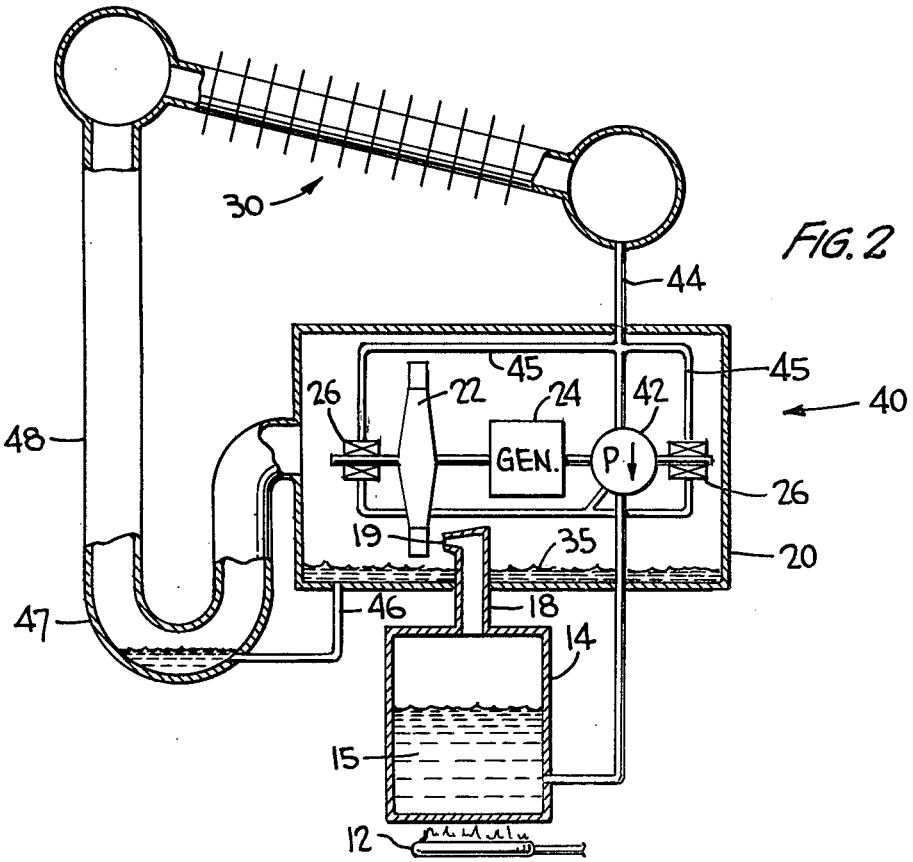
FIG. 2 is a schematic view of a second embodiment of a power plant of the type described.

Power plant 10 relies on the gravity feed of condensate from the condenser into the boiler. This will result in a power plant whose vertical height is substantially greater than a power plant wherein the condensate is returned to the boiler through a pump. Power plant 40, shown in FIG. 2, is an arrangement for reducing the overall height of a power plant. Referring now to FIG. 2, power plant 40 comprises the three main components namely, main boiler 14, cannister 20 containing the prime mover, and condenser 30. In this case, however, return conduit 45 connected to the condenser returns condensate to pump 42 also mounted on shaft 25 together with turbine 22 and generator 24. Pump 42 is effective to pressurize the condensate flowing into the pump from the condenser and force it into the boiler 14. Thus the overall height of the power plant is significantly reduced as compared with the arrangement shown in FIG. 1.

As in the case of power plant 10, liquid working fluid collected in the sump of cannister 20 is drained therefrom by transferring the working fluid to the condenser. Where the sump liquid in the heat exchanger is indirectly heated in the first embodiment of the invention, the sump liquid in this embodiment of the invention is directly heated in a heat exchanger formed by a U-shaped loop 47 of conduit 48 that conducts exhaust vapor to the condenser. Thus, liquid in the sump is drained by gravity via conduit 46 into the bottom of loop 47 which is lower than the sump level of the cannister. Exhaust working fluid passing through conduit 40 vaporizes the liquid in the bottom of the loop carrying the vaporized sump liquid upwardly into the condenser where condensation takes place. The gaseous working fluid passing through conduit 48 will entrain liquid that collects in loop 47; and the entrained liquid will be carried by the gaseous working fluid into the condenser.

The heat required to raise the liquid in loop 47 into the condenser is extracted from the vapor which comes "wetter" thereby. In many instances of operation, the vapor exhausted from the turbine will be somewhat superheated with the result that the superheat is lost by the vaporization of liquid in loop 47. This has the advantage of reducing the amount of heat that the condenser has to reject to the atmosphere thereby increasing its efficiency. Furthermore, the overall advantage of the arrangement of the embodiment shown in FIG. 2 it that no additional fuel is utilized for vaporizing the drained liquid.

It is believed that the advantages and improved results furnished by the method and apparatus of the present invention are apparent from the foregoing description of the preferred embodiment of the invention. Various changes and modifications may be made without departing from the spirit and scope of the invention as described in the claims that follow.

We claim:

1. A closed cycle power plant comprising:
(a) a boiler for converting working fluid into vapor;
(b) a cannister housing a prime mover driven by said vapor and having a sump for collecting liquid working fluid;
(c) a condenser connected to the cannister via an exhaust conduit for condensing vapor exhausted by the prime mover;
(d) condensate return means for returning condensate from the condenser to the boiler; and
(e) means responsive to thermal energy contained in the working fluid for transferring liquid working fluid in the sump to the condenser.

2. A closed cycle power plant according to claim 1 wherein the condenser is located at a level above the cannister, and the means for transferring includes a heat exchanger for vaporizing liquid drawn from the sump.

3. A closed cycle power plant according to claim 2 wherein the heat exchanger is located below the sump, where liquid therefrom drains by gravity.

4. A closed cycle power plant according to claim 3 wherein sump liquid in the heat exchanger is indirectly heated.

5. A closed cycle power plant according to claim 4 wherein the heat exchanger comprises a second boiler.

6. A closed cycle power plant in accordance with claim 5 wherein said second boiler is heated by the liquid in th first mentioned boiler.

7. A closed cycle power plant according to claim 5 wherein said second boiler is constituted by a jacket surrounding the first mentioned boiler.

8. A closed cycle power plant according to claim 3 wherein the heat exchanger is a direct contact heat exchanger.

9. A closed cycle power plant according to claim 8 wherein vaporized working fluid directly contacts liquid drained from the sump.

10. A closed cycle power plant according to claim 9 wherein the heat exchanger is located in the exhaust conduit.

11. A closed cycle power plant according to claim 10 wherein the exhaust conduit contains an elbow located below the level of the sump and the sump is connected to the elbow for draining liquid into the sump to the elbow.

12. A closed cycle power plant according to claim 1 wherein the condenser is located at a level above the cannister, and the means for transferring includes means to drain liquid in the sump into said exhaust conduit for entraining liquid from the sump in said exhaust vapor which carries the entrained liquid into the condenser.

13. In a closed cycle power plant including a boiler for converting liquid working fluid into a vapor; a cannister housing a prime mover driven by said vapor and having a sump for collecting liquid working fluid, and an exhaust conduit for conducting vapor exhausted from the cannister into a condenser which converts the vapor into condensate; a bearing lubrication system for conducting a portion of the condensate from the condenser into the cannister for lubricating the bearings on which the prime mover is mounted, the improvement comprising transferring liquid working fluid in the sump to the condenser by heating the last mentioned fluid.

14. A method for operating a closed cycle power plant comprising:
(a) heating liquid working fluid in a boiler to convert the liquid into vapor;
(b) expanding the vapor in a prime mover contained in a cannister having a sump for collecting liquid working fluid;
(c) condensing vapor exhausted by the prime mover in a condenser for producing condensate;
(d) conducting a portion of said condensate from the condenser to the cannister for lubricating the bearings on which the prime mover is mounted and conducting the remainder of the condensate to the boiler; and
(e) returning liquid working fluid in the sump to the condenser by contacting the last mentioned fluid with vapor exhausted from the prime mover.

15. A closed cycle power plant according to claim 1 wherein said condenser is located at a level above said cannister, and said means for transferring causes vapor exhausted from the prime mover to contact and thereby entrain liquid working fluid from the sump and deliver the entrained liquid to the condenser.

16. Apparatus comprising
(a) a cannister containing a prime mover driven by vapor produced by heating a liquid working fluid in a boiler and having a sump for collecting liquid working fluid;
(b) a condenser connected to the cannister by an exhaust conduit for condensing vapor exhausted by the prime mover and for returning the condensate to the boiler;
(c) a heat exchanger located at a lever below the sump and into which liquid in the sump drains by gravity; and
(d) means for heating liquid in the heat exchanger to vaporize the liquid.

17. Apparatus according to claim 16 including means for transferring vapor produced by the heat exchanger into the condenser.

18. Apparatus comprising:
(a) a cannister containing a prime mover driven by vapor produced by heating a liquid working fluid in a boiler and having a sump for collecting liquid working fluid;
(b) a condenser connected to the cannister by an exhaust conduit for condensing vapor exhausted by the turbine and for returning the condensate to the boiler;
(c) means subjecting liquid from the sump to vapor exhausted by the turbine for entraining such liquid; and
(d) means for carrying for conducting entrained liquid into the condenser.

* * * * *